US005380454A

United States Patent [19]

Griepenburg et al.

[11] Patent Number: 5,380,454

[45] Date of Patent: Jan. 10, 1995

[54] LOW TEMPERATURE NON-CAUSTIC OVEN CLEANING COMPOSITION

[75] Inventors: Ronald G. Griepenburg, Oradell, N.J.; William Feuer, Nyack, N.Y.; James Feng, Fort Lee, N.J.

[73] Assignee: Reckitt & Colman Inc., Wayen, N.J.

[21] Appl. No.: 89,232

[22] Filed: Jul. 9, 1993

[51] Int. Cl.[6] ..... C11D 7/12; C11D 7/60; C11D 7/26; C11D 7/32

[52] U.S. Cl. ..... 252/174.14; 252/548; 252/153; 252/170; 252/173; 252/DIG. 1; 252/DIG. 14

[58] Field of Search ..... 252/174.14, 548, DIG. 1, 252/173, DIG.14, 170, 153, 159, 156, 158, 167, 305, 90; 134/39, 40

[56] References Cited

U.S. PATENT DOCUMENTS

| | | | |
|---|---|---|---|
| 3,658,711 | 4/1972 | Mukai et al. | 252/153 X |
| 3,779,933 | 12/1973 | Eisen | 252/153 X |
| 3,806,460 | 4/1974 | Mukai et al. | 252/153 X |
| 3,808,051 | 4/1974 | Schoenholz et al. | 252/156 X |
| 3,813,343 | 5/1974 | Mukai et al. | 252/153 X |
| 3,829,387 | 8/1974 | Wise et al. | 252/156 X |
| 3,881,948 | 5/1975 | Schoenholz et al. | 134/40 X |
| 4,105,574 | 8/1978 | Culmone et al. | 252/153 X |
| 4,116,848 | 9/1978 | Schoenholz et al. | 252/156 X |
| 4,135,947 | 1/1979 | Rink | 252/153 X |
| 4,157,921 | 6/1979 | Baturay et al. | 252/159 X |
| 4,193,886 | 3/1980 | Schoenholz et al. | 252/156 X |
| 4,236,935 | 12/1980 | Schoenholz et al. | 134/40 X |
| 4,921,629 | 5/1990 | Malihi et al. | 252/156 X |
| 5,102,573 | 4/1992 | Han et al. | 252/153 |

FOREIGN PATENT DOCUMENTS

| | | |
|---|---|---|
| 1047903 | 2/1979 | Canada . |
| 0103466 | 6/1987 | European Pat. Off. . |
| 1275740 | 5/1972 | United Kingdom . |

OTHER PUBLICATIONS

*Structure, Chemistry, and Relationship to Natural Clays*, Laponite Technical Bulletin L-104, Aug. 1990, Waverly Mineral Products Co.

*Veegum, the Super natural ingredient*, Sep. 1987, R. T. Vanderbilt Company, Inc.

*Primary Examiner*—Paul Lieberman
*Assistant Examiner*—Douglas J. McGinty
*Attorney, Agent, or Firm*—Frederick H. Rabin

[57] ABSTRACT

A non-caustic oven cleaner composition comprises from 1% to 12% monoethanolamine, from 2% to 20% diethylene glycol monobutyl ether and from 1 to 10% of sodium or potassium carbonate. The composition, preferably in an aerosol formulation having from 2% to 10% propellent, is effective at ambient room temperatures. The preferred carbonate is potassium carbonate. Up to 60% of the monoethanolamine can be replaced with an equivalent amount of diethanolamine.

9 Claims, No Drawings

LOW TEMPERATURE NON-CAUSTIC OVEN CLEANING COMPOSITION

FIELD OF THE INVENTION

This invention relates to non-caustic aqueous oven cleaning compositions and methods for their use. More particularly, it relates to compositions which provide effective oven cleaning at ambient room temperature over a period of 15 minutes to 2 hours.

BACKGROUND OF THE INVENTION

Among the most distasteful of necessary household tasks is cleaning ovens. When foods are roasted or baked in a oven, various amounts of fat, vegetable products, etc., splatter on the top and sides and run down to the bottom of the oven. The heat of the oven surfaces then dehydrates the substances and causes them to polymerize and undergo other chemical changes which produce highly insoluble products which adhere tightly to the oven surfaces and are extremely difficult to remove. In addition, roasting pans, grills, utensils and the like acquire similar coatings. For many years, alkaline paste cleaners were used as chemical agents for cleaning ovens. These cleaners contained large concentrations of lye, which saponifies the fats to soluble soaps and thus facilitates their removal. However, such paste cleaners had to be laboriously painted on to the oven surfaces and the task of removal was just as laborious. Furthermore, since they contained high concentrations of caustic alkalies, in the range of about 8%, rubber gloves had to be worn and, during removal, either large amounts of water had to be used or the alkali had to be neutralized with acidic substances such as vinegar. For household use, such alkali paste cleaners have now been replaced with combinations of alkalies and various solvents, generally packaged in the form of aerosols or sprays. Although the task of cleaning ovens with these substances is considerably less arduous than with paste cleaners, the active ingredient in many of these aerosol or spray cleaners continues to be potassium hydroxide or sodium hydroxide. These caustic alkali compositions provide excellent oven cleaning effectiveness, but there are several drawbacks in their use. Caustic alkalies are dangerous to the eyes and, when used in the form of pressurized aerosol, there is extremely great hazard. Additionally, caustic alkalies are irritating to the skin, thus requiring that the user wear rubber gloves or other protective materials.

In place of caustic alkali compositions, a number of oven cleaning compositions have been developed which contain various other cleaners, solvents, surfactants, builders, etc., all intended to provide oven cleaning effectiveness without the hazards and unpleasantness of caustic alkalies. Most of these non-caustic compositions require that the oven be cleaned at elevated temperatures, generally above 120° C., although there are so-called low temperature oven cleaners which can be used in the 95° C. range with some even claiming to be effective at temperatures as low as about 65° C. Furthermore, even though these compositions do not contain sodium hydroxide or potassium hydroxide, many of them contain other ingredients which are environmentally undesirable particularly when used in concentration sufficient to provide effective oven cleaning.

Other methods of oven cleaning have been proposed, including the use of catalytic oven coatings intended to provide continuous self cleaning at normal baking temperatures; however, they tend to lose their effectiveness over time. Another method has been to design ovens for self cleaning with auxiliary heaters intended to raise oven temperatures to about 900° C. in order to burn off the baked-on food residue. However, resorting to such high temperatures requires specially designed oven locks, additional insulation, etc., all of which renders this system generally undesirable for domestic use. Thus, as a practical matter, improved oven cleaning effectiveness will depend on the development of suitable and efficient detergent-type compositions.

Early efforts to develop non-caustic oven cleaners are represented, for example, by British Patent Specification No. 1,275,740, which discloses an aqueous composition comprising an amine component, which reacts with grease and fat at elevated temperatures to loosen cooking residue, and at least one anionic or non-ionic surfactant. A number of amines are disclosed and the preferred amine is monoethanolamine. The subject compositions also preferably contain an alkali-stable organic solvent. A wide variety of such solvents are disclosed including various glycols such as ethylene glycol and propylene glycol. The compositions preferably also contain an alkaline builder of which sodium carbonate appears to be preferred. The compositions are designed to be used in ovens pre-heated to a temperature of from about 65° to about 120° C.

U.S. Pat. No. 3,658,711 discloses a non-caustic water-based oven cleaning composition comprising a soap, an "inorganic cleaner", and an "amine enhancing agent". Included among the inorganic cleaners are sodium and potassium carbonates. Preferably, the compositions also include, as humectants, various organic solvents including diethylene glycol monobutyl ether. Although there is a statement to effect that the disclosed compositions can be applied at ambient room temperature, it is also stated quite clearly that the most efficient method of using the compositions is to apply them to an oven pre-heated and maintained at a temperature of about 93° C.

U.S. Pat. No. 3,806,460 discloses oven cleaner compositions which can be used at temperatures as low as about 65° C. The composition comprises alkali metal or ammonium salts of various inorganic acids, such as sodium or potassium carbonates, as a required "non-caustic inorganic cleaner". Another required ingredient is an amine or ammonia; among the possible amines, monoethanolamine and diethanolamine are mentioned, although these are not preferred. A third required ingredient appears to be an organic solvent having a boiling point above 120° C. and these can include various ethers and alcohols.

U.S. Pat. Nos. 3,808,051, 3,881,948, 4,116,848, 4,193,886 and 4,236,935 constitute a series of patents disclosing non-caustic oven cleaners in which the operating temperatures are in the range of about 120° C. to 287° C. In U.S. Pat. Nos. 3,808,051 and 4,116,848, the compositions include at least one alkali metal salt of a weak organic acid. A possible additional ingredient in these compositions is a polyhydric alcohol, particularly sorbitol. In U.S. Pat. No. 3,881,948, the polyhydric alcohol (sorbitol) is the key ingredient and, in addition, an "alkaline acting catalyst" capable of accelerating alcoholysis reactions is required. The alkaline acting catalyst include various alkali metal and alkaline earth metal bases and salts, such as sodium carbonate and potassium carbonate, and even sodium or potassium hydroxide (in which case, the compositions cannot be regarded as non-caustic). U.S. Pat. Nos. 4,193,886 and 4,236,935 disclose weakly alkaline oven cleaning compositions comprising a polyhydric alcohol, at least one alkali metal salt of a weak organic acid, and an alkali metal bicarbonate to accelerate the alcoholysis reaction. Even though the title of U.S. Pat. No. 4,193,886 is "Novel Low Temperature Cleaner", the minimum operating temperature is 120° C., with the preferred temperature being in the range of about 150° to 175° C.

U.S. Pat. No. 3,813,343 discloses oven cleaning compositions in which dimethylsulphoxide is added to facilitate removal of grease and fat.

U.S. Pat. No. 4,105,574 discloses a non-caustic oven cleaner comprising monoethanolamine, an etherified alkylene glycol solvent and, as a third essential ingredient, a specific sodium magnesium silicate thickening agent. The preferred etherified alkylene glycol solvent is diethylene glycol monoethyl ether, but diethylene glycol monobutyl ether is also mentioned. The disclosed composition can also contain "alkaline builders", with sodium and potassium carbonates mentioned. The operating temperature for oven cleaning is about 93° C.

U.S. Pat. No. 4,135,947 discloses oven cleaning compositions which are usable at the relatively low temperature of 90° C. The compositions require (1) a water soluble organic amine which can be monoethanolamine or diethanolamine, (2) a water soluble organic solvent which, in many specific examples, is diethylene glycol monobutyl ether (termed "2-butoxyethoxy-ethanol"), and (3) a sufficient amount of carbon dioxide to reduce the pH of the composition to a value of 10 or less.

Canadian Patent No. 1,047,903 discloses an oven cleaner operative at room temperature. The principal cleaning ingredient is an alkanolamine, but a "small amount"—0.5% to 4% —of an alkali metal hydroxide is also required.

The various non-caustic oven cleaner compositions currently available have been less than ideal: some require undesirably high operating temperatures; in some, cleaning effectiveness is not sufficient at concentrations which are not irritating to the user; some employ too high a concentration of volatile organic compounds and thus violate environmental regulations; etc. Accordingly, it would be desirable to provide a non-caustic aqueous based oven cleaner composition which does not have these disadvantages.

SUMMARY OF THE INVENTION

It has now been discovered that non-caustic aqueous compositions comprising (1) from about 1 to about 12% monoethanolamine, (2) from about 2 to 20% of diethylene glycol monobutyl ether, and (3) from about 1 to about 10% sodium or potassium carbonate are extremely effective as oven cleaners at room temperature. This combination of active ingredients provides unexpected synergistic effectiveness at room temperature, resulting in rapid oven cleaning without the necessity of having to heat the oven surfaces. The preferred alkali metal carbonate is potassium carbonate. Preferred ranges for three ingredients are: 2.5 to 8% of monoethanolamine, 3 to 15% of diethylene glycol monobutyl ether; and 2 to 8% of potassium carbonate. Up to 60% of the monoethanolamine can be replaced by an equivalent weight percentage of diethanolamine. Preferred is an aerosol formulation which consists essentially of from 90 to 98% of the aqueous composition and from 2 to 8% of a propellent.

DETAILED DISCLOSURE

This invention provides non-caustic aqueous cleaner compositions capable of removing baked-on organic matter from a surface. Although the principal contemplated use for these compositions is oven cleaning, they are also useful for pots, pans, grills and similar cooking surfaces. The invention also includes methods for removing baked-on food substances from cooking surfaces, particularly from ovens, which method generally comprises applying the aqueous non-caustic composition to a surface, letting the composition remain on said surface for sufficient time to dissolve and/or decompose the baked-on food components, and then removing said composition and the food soil.

The first essential component of the oven cleaning composition is monoethanolamine which can be used in an amount from about 1 to about 12 weight % of the aqueous composition. The preferred range for this ingredient is from 2.5 to 8%, with about 5% being a especially suitable amount. Since monoethanolamine is classified as a "volatile organic compound" for environmental purposes, the amount of monoethanolamine present in oven cleaning compositions is subject to governmental regulations and restrictions. Diethanolamine, which is not classified as a "volatile organic compound" and which has alkaline activity similar to the activity of monoethanolamine, can be substituted for up to about 60% of the required amount of monoethanolamine.

The second essential component for the oven cleaning composition is diethylene glycol monobutyl ether (sold under the trademark Butyl Carbitol), which serves the functions of aiding the penetration of the composition into baked-on grease, dissolving the fats and greases which are removed, slowing the evaporation of the monoethanolamine from the oven wall (particularly where a heated oven surface is being treated), and reducing the tendency of the composition to foam. Diethylene glycol monobutyl ether (DGMBE) should be present in the formulation in an amount of from about 2% to about 20% by weight, preferably from 3 to 15% by weight. A typical oven cleaning composition will have from about 5% to about 10% of DGMBE with the higher amounts within this range employed where there are no other organic solvents in the composition and/or where it is desired to keep foaming to a minimum. It has been found that about 5% of DGMBE is generally sufficient for solvent purposes. However, increasing the DGMBE to a range of about 8 to 12%, preferably about 10%, provides better foam control and this amount is particularly suitable in aerosol formulations. The presence of about 10% DGMBE results in the suppression of excessive foaming while preserving sufficient foam for adhesion purposes.

The third essential ingredient for room temperature cleaning is sodium carbonate or potassium carbonate, with potassium carbonate being preferred. This ingredient should be present in the amount of from about 1% to about 10% by weight of the aqueous composition. A suitable composition contains about 5% potassium carbonate. At cleaning temperatures in the "warm oven" range—i.e., 80° to 90° C.—sodium bicarbonate and potassium bicarbonate are nearly as effective as the corresponding alkali metal carbonates. However, for effective rapid action at room temperature the carbonates are required.

In addition to the aforementioned required active ingredients, it is also necessary for the oven cleaning composition to contain thickening agents so that composition will adhere to the roof and vertical surfaces. The thickening agent must be generally compatible with the other ingredients of the composition and should not adversely affect them or itself be adversely affected by the other ingredients. Suitable thickening agents include colloidal magnesium aluminum silicate (Veegum, Laponite), hydroxyethyl cellulose, sodium carboxymethyl cellulose, sodium carboxyethyl cellulose, bentonite, alginate, amylopectin starch, carboxyl vinyl polymers, xanthan gums, fumed amorphous silica, and the like. The type and amount of thickening agent can be selected to provide a pseudo-plastic composition having a viscosity of between about 50 to about 1500 cps., preferably about 100 to about 500 cps. as determined on a Brookfield LVT viscometer using a No. 2 spindle at 12 rpm.

Colloidal magnesium aluminum silicates sold under the trademark Veegum are particularly suitable. With Veegum T, the amount of actual thickener in the aqueous cleaning composition should be in the range of from about 0.5 to about 1.5%, preferably about 0.8%. Veegum T is conveniently employed in an aqueous premix composition containing about 3% of magnesium aluminum silicate; when Veegum T is used as an ingredient in formulating the cleaning compositions of this invention, the amount of the 3% premix employed should be between about 16 and about 50% in order to yield the desired amount of thickener. For a thickener concentration of 0.8%, the 3% Veegum T premix in an amount of 27% of the entire aqueous composition must be used.

In order to improve the adherence of the oven cleaner composition to the baked-on residue to be removed, small amounts of additional thickeners such as beeswax, microcrystalline wax, paraffin wax emulsions or powders may be added to the composition. These can be present in amounts up to about 5% by weight, preferably from about 0.1 to about 2% by weight. These thickeners can also serve as opacity agents—i.e., they make the cleaning composition more easily visible when applied to oven surfaces.

The oven cleaning compositions may preferably also contain minor amounts of anionic and/or non-ionic surface active agents which will cause the solution to spread evenly over the soiled surface and to maintain a desired level of foaming. These non-ionic or anionic surfactants should, of course, be compatible with the other ingredients contained in the composition. Surfactants can be present in an amount up to about 5% of the aqueous composition, with preferred amounts in the range of 0.01% to about 3%.

Examples of anionic surfactants include: (a) carboxylic acids such as soaps of straight chain naturally occurring fatty acids, chain-substituted derivatives of fatty acids, branched-chain and odd-carbon fatty acids, acids from foam paraffin oxidation, and carboxylic acids with intermediate linkages; and (b) sulphuric esters such as sodium lauryl sulphate, tallow alcohol sulphates and coconut alcohol sulphates. A particularly suitable anionic surfactant is sodium N-lauroyl sarcosinate (Maprosyl, Sarkosyl). Examples of non-ionic surfactants include polyethyleneoxy ethers of alkylphenols, alkanols, mercaptan esters as well as polyethyleneoxy compounds with amine links.

The oven cleaning compositions of this invention may also contain additional minor amounts of wetting agents, chelating agents, other solvents, corrosion inhibitors and fragrance, and also other additives normally added in minor amount to spray liquid or aerosol oven cleaners.

The compositions may be used in liquid form, in which case they are conveniently packaged in an appropriate container. The composition may be sprayed directly onto the surfaces to be cleaned by means of, for example, a trigger sprayer.

In a preferred form, the oven cleaning compositions of this invention are supplied in self-contained valve controlled aerosol units which provide a fine spray or foam upon activation of the valve. The aerosol container unit consists of a pressure-tight aerosol container having a valve control opening and containing the aqueous non-caustic oven cleaner composition of this invention and from about 2 to about 10% of a propellant. Preferably, the propellant is used in an amount of about 5%. Propellants are selected from the well known compatible propellants such as isobutane, n-butane, n-propane and mixtures thereof. The propellant used should not adversely react with any components of the composition. An aerosol composition comprising about 5% of one of the above-mentioned propellants, about 10% of DGMBE and about 1% of an anionic surfactant is particularly suitable in that this proportion of solvent, propellent and surfactant provides good adhesion of the composition to the oven surface without excessive foaming.

Compositions of this invention can be applied to oven surfaces or to other surfaces encrusted with baked-on food residue at temperatures ranging from ambient room temperature (20°–25° C.) up to about 95° C. The amount applied should be sufficient to cover the entire surface to be cleaned. The time required to loosen or soften the residue sufficiently to facilitate mechanical removal depends largely upon the temperature used, the residence time of the composition and the particular characteristics of the residue itself. It has been found that, at temperatures in the 85° to 95° range, baked-on food residues become sufficiently loosened or softened in a period of from about 2 to 10 minutes and can then be easily mechanically removed. The most stubborn baked-on residue becomes sufficiently loosened or softened within about 30 minutes. It is important, when operating at these warm temperatures, to remove the softened residue as soon as conveniently possible in order to avoid drying of the cleaner composition. If such drying out occurs, small additional amounts of the composition can be applied. In most instances, even the toughest residues in cooking ovens are removed in a single application.

One of the principal advantages derived from this invention is that the non-caustic aqueous compositions provide excellent effectiveness at ambient room temperature. The is apparently due to a synergistic response obtained as a result of the use of the three active ingredients, namely monoethanolamine, diethylene glycol monobutyl ether, and sodium or potassium carbonate. Monoethanolamine and diethylene glycol monobutyl ether have been described, both individually and in combination, as possible components of non-caustic oven cleaners. Likewise, alkali metal, ammonium and alkaline earth metal salts—both organic and inorganic—have been used as possible components of oven cleaner compositions. It has now been discovered, however, that two specific salts—namely sodium carbonate and potassium carbonate—appear to potentiate the oven cleaning effectiveness at room temperature of aqueous compositions comprising monoethanolamine and diethylene glycol monobutyl ether. Thus, the use of the aqueous compositions of this invention makes possible the effective cleaning of ovens at ambient room temperature in a relatively short period of time of from about 15 minutes to 2 hours.

The oven-cleaning methods of this invention comprise the application to soiled oven surfaces of the above-described cleaning compositions, particularly aerosol formulations thereof. After the baked-on food residues have been loosened or softened, they can be easily removed by washing, scraping, wiping, scrubbing or, if convenient, flushing with water.

This invention will be better understood by reference to the following examples, which are here included for illustrative purposes only and are not to be construed as limitations.

EXAMPLE 1

A composite soil having the following ingredients was prepared:

peanut oil—90 grams
corn oil—50 grams
cherry pie mix—50 grams
ground beef—50 grams
ground pork—50 grams
sodium glutamate—2 grams
sodium carbonate—2 grams
water—50 grams These ingredients were mixed in a Pyrex baking dish and heated for 1½ hours at a temperature of 204° C. in an oven.

Rectangular white porcelain test plates having dimensions of 14 cm by 15.2 cm are used. 1.2 grams of the baked composite soil is applied uniformly, with a brush, over the entire surface of each plate. The coated plates are then placed in uncovered aluminum baking trays; these are put onto shelves of a large convection oven. The coated plates are then baked for 1 hour at a temperature of 232° C.

Test plates containing this composite soil were used in Examples 3, 4, 5, 6 and 7, below.

EXAMPLE 2

A composite soil having the following ingredients was prepared:

ground beef—120 grams
cheddar cheese—58 grams
milk—120 ml
sugar—110 grams
cherry juice—120 ml
tapioca—19 grams
raw egg (without shell)—1
flour—15 grams
tomato juice—120 ml These ingredients are stirred slowly for about 3 minutes until well mixed and lumpy.

The prepared mixture is then coated onto test plates and baked in the manner described in Example 1. Soiled plates prepared according to this method were used in Example 11, below.

EXAMPLE 3

Six spray aqueous oven cleaning preparations were prepared and the physical characteristics were evaluated in comparison with a commercial caustic aqueous oven cleaning preparation. The compositions of these formulations are as follows:

| | FORMULATION NO. | | | | | | |
|---|---|---|---|---|---|---|---|
| | 3-1 % | 3-2 % | 3-3 % | 3-4 % | 3-5 % | 3-6 % | 3-7 % |
| Veegum T (3.0%) | 27.00 | 27.00 | 27.00 | 27.00 | 27.00 | 27.00 | 27.00 |
| Paraffin wax emulsion | 1.00 | 1.00 | 1.00 | 1.00 | 1.00 | 1.00 | 1.00 |
| Monoethanolamine | 2.80 | 2.80 | 2.80 | 2.80 | 2.80 | 2.80 | 2.80 |
| DGMDE | 5.00 | 10.00 | 10.00 | 5.00 | 3.00 | 3.00 | 3.00 |
| Butyl Cellosolve(1) | | | | | 9.00 | 9.00 | 9.00 |
| Sodium N-Lauroyl Sarcosinate | | 1.00 | 1.00 | 3.60 | 3.60 | 3.60 | 3.60 |
| Potassium Carbonate | 5.00 | 5.00 | 5.00 | 4.70 | 4.70 | | |
| Triton CF-54 (10%)(2) | 0.20 | 0.20 | 0.20 | 0.20 | 0.20 | 0.20 | 0.20 |
| EDTA(3) | | | | 0.38 | 0.38 | 0.38 | 0.38 |
| Tri-potassium phosphate | | | | | | 5.00 | 5.00 |
| Fragrance | | | 0.10 | | | | 0.10 |
| Water | 59.00 | 53.00 | 52.90 | 55.32 | 48.32 | 48.02 | 47.92 |

(1)ethylene glycol diethyl ether - solvent
(2)wetting agent
(3)chelating agent

Formulations Nos. 3-1, 3-2, 3-3, 3-4 and 3-5 are compositions according to this invention. Formulation 3-7 is the commercially available composition but, because of high VOC content and the presence of a phosphate salt, its use is subject to environmental restriction. Formulation 3-6 corresponds to the commercial preparation, except for the absence of fragrance.

Formulations 3-1, 3-4 and 3-5 had generally satisfactory physical characteristics except for excessive foaming when sprayed onto a test surface. Formulations 3-2 and 3-3, which are identical except for absence of fragrance in 3-2, had superior foaming characteristics.

A comparison was then done on the effectiveness of formulation 3-3 and commercial formulation 3-7 as an oven cleaner using test plates prepared according to Example 1. Ten plates were used. Each plate was divided into halves by a strip of masking tape approximately 1 cm wide. On each plate, there was applied 2.9 grams of formulation 3-3 on one side and 2.9 grams of formulation 3-7 on the other. The formulations were sprayed on, with care taken to ensure that the dividing strip and the opposite side were shielded. The plates were maintained in a vertical position, and then placed in a closed non-absorbent container having approximately the same surface area to volume ratio as a domestic oven. The inside of the container was maintained at a temperature of 65° C. for approximately 8 minutes. Each plate was then placed under cold running tap water and then sponged until no further soil was removed. The amount of soil removed was visually evaluated and, for both formulations 3-3 and 3-7, more than 90% of the soil had been removed.

Formulation 3-3 was then evaluated against another commercially available non-caustic oven cleaner in a pump spray formulation, whose directions for use indicated that it should be used at a temperature of about 246° C. This commercial formulation had the following constituents:

| | FORMULATION NO. 3-8 % |
|---|---|
| Veegum T | 1.5 |
| potassium glycolate (50%) | 9.3 |
| potassium acetate (50%) | 9.3 |
| sodium dodecyl diphenyl oxide disulphonate (surfactant) | 0.1 |

-continued

| | FORMULATION NO. 3-8 % |
|---|---|
| fragrance | 0.2 |
| water | 79.6 |

Oven cleaning effectiveness was evaluated using test plates prepared according to Example 1 and divided in half as described above. A total of 20 plates were used. The plates were placed in an oven set at 93° C. When the plates had attained the oven temperature, they were removed one at a time and 4 grams of formulation 3-3 was sprayed on the left side of each plate. The plates were placed back in the oven for 15 minutes, removed and washed with water as described above. Then, on the right side of each plate, there was sprayed 4 grams of formulation 3-8. The plates were then placed in an oven at a temperature of 246° C. for 30 minutes. The plates were then removed and washed under tap water. The percentage of soil removed by formulation 3-3 after the first 15 minutes of the test was greater than 90%. The percentage of soil removed by commercial formulation 3-8 at the end of the test was 90.0%.

EXAMPLE 4

Five oven cleaning formulations were prepared in order to compare the effects of potassium carbonate and potassium bicarbonate on oven cleaning effectiveness in a warm oven. The formulations had the following content.

| | FORMULATION NO. | | | | |
|---|---|---|---|---|---|
| | 4-1 % | 4-2 % | 4-3 % | 4-4 % | 4-5 % |
| Veegum T (3.0%) | 30.0 | 30.0 | 30.0 | 30.0 | 30.0 |
| Monoethanolamine | 5.0 | 5.0 | 5.0 | 5.0 | 5.0 |
| Diethanolamine | | | | | 5.0 |
| DGMBE | 5.0 | 5.0 | 5.0 | 5.0 | 5.0 |
| Potassium Carbonate | | | 5.0 | 5.0 | |
| Potassium Bicarbonate | | 5.0 | | 5.0 | 5.0 |
| Sodium N-lauroyl sarcosinate (30%) | 1.0 | 1.0 | 1.0 | 1.0 | 1.0 |
| water | 59.0 | 54.0 | 54.0 | 49.0 | 49.0 |

The formulations were tested on test plates prepared according to the method of Example 1. Using a glue gun and a sufficient number of test plates, circles approximately 1 cm in diameter were outlined on the plates. The plates were then heated on a hot plate to a temperature of 82° C. and kept constant at this temperature. The glue solidified, thereby creating a number of hardened discrete circles. Into each such circle was placed 1 gram of one of the five formulations. At 1 minute intervals, one circle representing each formulation was wiped clean and the percentage of soil removal was recorded. The results are given in the following table.

| | PERCENT SOIL REMOVAL TIME | | | | | |
|---|---|---|---|---|---|---|
| | 1 MINUTE | 2 MINUTES | 3 MINUTES | 4 MINUTES | 5 MINUTES | 6 MINUTES |
| 4-1 | 0 | 0 | 0[5] | 50[6] | 85 | 100 |
| 4-2 | 0 | 35 | 100 | | | |
| 4-3 | 0 | 100 | | | | |
| 4-4 | 0 | 50 | 100 | | | |

-continued

| | PERCENT SOIL REMOVAL TIME | | | | | |
|---|---|---|---|---|---|---|
| | 1 MINUTE | 2 MINUTES | 3 MINUTES | 4 MINUTES | 5 MINUTES | 6 MINUTES |
| 4-5 | 0 | 95 | | | | |

[5]temperature 88°
[6]temperature 85°

These data show that the presence of sodium carbonate and/or sodium bicarbonate in the oven cleaning formulation potentiates oven cleaning effectiveness. A comparison of formulations 4-2, 4-3 and 4-4 shows that potassium carbonate is slightly more effective than potassium bicarbonate; this slight difference at 82° C. becomes a large and significant difference at room temperature, as shown in the following example. The excellent effectiveness of formulation 4-5 can be ascribed to the presence of double the amount of amine than in the other formulations.

EXAMPLE 5

Non-caustic aqueous oven cleaning compositions containing various inorganic salts were evaluated for oven cleaning effectiveness at room temperature (21° C.).

These formulations all had the following composition:

| INGREDIENT | % |
|---|---|
| Veegum T (3.0%) | 30.0 |
| Monoethanolamine | 5.0 |
| DGMBE | 5.0 |
| Sodium N-lauroyl sarcosinate | 1.0 |
| Salt | 5.0 |
| Water | 54.0[7] |

[7]59.0 in the control formulation

Test plates with hardened glue circles were prepared according to the test procedure of Example 4, except that after the glue circles had hardened, the plates were removed from the hot plate and allowed to attain room temperature before the various formulations were applied. The treated plates were maintained at room temperature for 6 hours and soil removal effectiveness was measured at 2-hour intervals. The percentage of soil removal at the 2-hour, 4-hour and 6-hour points are shown in the following table, in which the figures represent an average of two replications.

| | PERCENT SOIL REMOVAL | | | |
|---|---|---|---|---|
| FORMULATION NO. | SALT | 2 Hours | 4 Hours | 6 Hours |
| 5-1 | potassium bicarbonate | 0 | 0 | 0 |
| 5-2 | potassium carbonate | 80 | 100 | 100 |
| 5-3 | sodium carbonate | 85 | 100 | 100 |
| 5-4 | sodium bicarbonate | 0 | 0 | 0 |
| 5-5 | magnesium carbonate | 0 | 0 | 0 |
| 5-6 | calcium carbonate | 0 | 13 | 45 |
| 5-7 | sodium sesquicarbonate | 0 | 100 | 100 |
| 5-8 | ammonium bicarbonate | 0 | 0 | 0 |
| 5-9 | sodium tetraborate | 0 | 15 | 80 |
| 5-10 | none | 0 | 0 | 0 |

These data show that, at room temperature, the presence of potassium carbonate or sodium carbonate provides enhanced and unexpected effectiveness. The other salts chosen for comparative testing are those which, from the prior art, are often used in oven cleaning combinations and would be expected to show results similar to potassium carbonate and sodium carbonate. Salts such as sodium metasilicate and trisodium phosphate were not considered for the test because of a high alkalinity in aqueous solution; the inorganic salts tested all produced aqueous solutions having a pH of 11.6 or less. Other phosphate salts were not considered since environmental regulations limit or prohibit their use. Lithium barcarbonate and lithium carbonate were not evaluated because of their low solubility.

EXAMPLE 6

The oven cleaning effectiveness of the following formulation

| | FORMULATION NO. 6 % |
|---|---|
| Veegum T (3.0%) | 27.0 |
| Paraffin wax | 1.0 |
| Monoethanolamine | 2.8 |
| DGMBE | 10.0 |
| Sodium N-lauroyl sarcosinate | 1.0 |
| Potassium Carbonate | 5.0 |
| Triton CF-54 (10%) | 0.2 |
| Fragrance | 0.1 |
| water | 52.9 |

was evaluated at room temperature. The general test method used was that of Example 3. 2 grams of formulation were applied to each half plate and the plates were allowed to stand at room temperature. The left side of each plate was washed after 2 hours and soil removal evaluated. The right side of the plate was washed and evaluated after 3 hours. The percentage soil removal (average of 20 replications) was:

2 hours—80.5%

3 hours—89.5%.

EXAMPLE 7

An aqueous oven cleaning composition comprising monoethanolamine, diethylene glycol monobutyl ether (DGMBE) and potassium carbonate was compared with similar compositions in which one or more of these essential active ingredients was absent, and with compositions containing potassium bicarbonate in place of potassium carbonate. Evaluations were done at room temperature. The test method was that of Example 6 with the identical composition being applied to both the left side and the right side of the test plates. The following table shows the content of each composition, along with oven cleaning effectiveness after 2 hours at room temperature. The soil removal data represent the average of both sides of the test plate.

| | FORMULATION NO. | | | | | | | | |
|---|---|---|---|---|---|---|---|---|---|
| | 7-1 % | 7-2 % | 7-3 % | 7-4 % | 7-5 % | 7-6 % | 7-7 % | 7-8 % | 7-9 % |
| Veegum T (3.0%) | 40 | 40 | 40 | 40 | 40 | 40 | 40 | 40 | 40 |
| Monoethanolamine | | 5 | 5 | 5 | 5 | | 5 | 5 | |
| DGMBE | 10 | | 10 | 10 | | 10 | 10 | | 10 |
| Potassium Carbonate | | | | 5 | 5 | 5 | | | |
| Potassium Bicarbonate | | | | | | | 5 | 5 | 5 |
| Water | 50 | 55 | 45 | 40 | 50 | 45 | 40 | 50 | 45 |
| Soil Removal | 0 | 0 | 0 | 95 | 0 | 0 | 0 | 0 | 0 |

These data show that all three ingredients of the oven cleaning compositions according to this invention are essential in order to provide rapid soil removal at room temperature. Omission of any one of the three required ingredients gives unsatisfactory results. Similarly, the substitution of sodium bicarbonate for sodium carbonate also gives unsatisfactory results at room temperature.

EXAMPLE 8

An aerosol formulation comprising a liquid concentrate and a propellant was prepared. The liquid concentrate had the following ingredients:

| | FORMULATION NO. 8 % |
|---|---|
| Veegum T (3.0%) | 27.0 |
| Paraffin Wax Emulsion | 1.0 |
| Monoethanolamine | 2.9 |
| DGMBE | 10.0 |
| Sodium N-lauroyl sacosinate (30%) | 1.0 |
| Potassium Carbonate | 5.0 |
| Triton CF-54 (10%) | 0.2 |
| Fragrance | 0.1 |
| Water | 52.8 |

The aerosol formulation consisted of 95% of liquid concentrate and 5% isobutane (propellant A-31).

EXAMPLE 9

Additional aerosol formulations were prepared according to method of Example 8 with liquid concentrates having the following formulations.

| | FORMULATION NO. | |
|---|---|---|
| | 9-1 % | 9-2 % |
| Veegum T (3.0%) | 27.00 | 27.00 |
| Paraffin Wax Emulsion | 1.00 | 1.00 |
| Monoethanolamine | 2.90 | 2.90 |
| DGMBE | 10.00 | 10.00 |
| Sodium N-Lauroyl sarcosinate (30%) | 1.00 | 1.00 |
| Potassium Carbonate (47% solution) | | 10.64 |
| Potassium Carbonate (anhydrous) | 5.00 | |
| Triton CF-54 | 0.02 | 0.02 |
| Fragrance | 0.20 | 0.20 |
| Distilled Water | 52.88 | 47.24 |

The use of liquid, rather than granular, potassium carbonate permits more rapid preparation of the liquid concentrate.

EXAMPLE 10

A formulation suitable for commercial use in a trigger spray container was prepared with the following ingredients:

| | FORMULATION NO. 10 % |
|---|---|
| Veegum T (3.0%) | 35.00 |
| Monoethanolamine | 3.00 |
| DGMBE | 5.00 |
| Sodium dodecyl diphenyl oxide disulphonate | 0.10 |
| Sodium o-phenylphenate(8) | 0.02 |
| EDTA | 0.10 |
| Potassium carbonate (anhydrous) | 5.00 |

-continued

| | FORMULATION NO. 10 % |
|---|---|
| Fragrance | 0.20 |
| Distilled water | 51.58 |

(8)preservative

As with the liquid concentrates for the aerosol formulation of Example 9, the anhydrous potassium carbonate can be replaced with an equivalent amount of potassium carbonate solution.

EXAMPLE 11

Trigger spray formulation No. 10 and aerosol formulation No. 9-1 were compared against a commercially available fume-free oven cleaner for effectiveness. The ingredients of the commercial trigger spray formulation (No. 11-1) are:

| | FORMULATION NO. 11-1 % |
|---|---|
| Veegum T (3.0%) | 50.0 |
| Potassium glycolate (50% solution) | 9.3 |
| Potassium acetate (50% solution) | 9.3 |
| Sodium dodecyl diphenyl oxide disulphonate | 0.1 |
| Fragrance | 0.2 |
| Water | 31.1 |

The ingredients of the liquid composition (No. 11-2) for the aerosol formulation are:

| | FORMULATION NO. 11-2 % |
|---|---|
| Xanthan gum | 0.24 |
| Potassium glycolate (50%) | 10.00 |
| Potassium acetate (50%) | 10.00 |
| Calcium carbonate | 6.00 |
| Sodium dodecyl diphenyl oxide disulphonate | 0.10 |
| sodium o-phenylphenate | 0.02 |
| Sodium nitrite(9) | 0.30 |
| Morpholine(9) | 0.30 |
| Fragrance | 0.20 |
| Water | 72.84 |

(9)corrosion inhibitors

The aerosol formulation comprised 93% of the liquid composition plus 7% percent of isobutane/propane/difluoroethane blend propellent.

Test plates prepared according to Example 2 were used. The commercial formulations were tested under the cleaning conditions called for on their labelling—namely, 30 minutes at 246° C.—and for 2 hours as room temperature. Formulations 10 and 9-1 according to this invention were tested at room temperature and evaluated after 2 hours. The cleaning effectiveness values are given in the following table.

| FORMULATION | TEST CONDITIONS | % SOIL REMOVAL |
|---|---|---|
| No. 11-1 | 30 minutes | 76.2 |
| Spray - commercial | 246° C. | |
| No. 10 | 2 hours | 72.8 |
| Spray - invention | room temperature | |
| No. 11-1 | 2 hours | 0.9 |
| spray - commerical | room temperature | |
| No. 10 | 2 hours | 76.8 |
| Spray - invention | room temperature | |
| No. 11-2 | 30 minutes | 63.8 |
| aerosol - commerical | 246° C. | |
| No. 9-1 | 2 hours | 90.8 |
| aerosol - invention | room temperature | |
| No. 11-2 | 2 hours | 0.0 |
| aerosol - commercial | room temperature | |
| No. 9-1 | 2 hours | 87.8 |
| aerosol - invention | room temperature | |

It is clear from these data that both aerosol formulations and trigger spray formulations of aqueous oven cleaners prepared according to this invention provided oven cleaning effectiveness equal to or better than commercially available fume-free oven cleaning formulations. The formulations of this invention are likewise fume free and have the advantage of being effective at room temperature, avoiding the necessity of having to maintain the oven at warm or high temperatures.

Various modifications of the compositions and methods of this invention may be made without departing from the spirit or scope thereof and it is to be understood that the invention is intended to be limited only as defined in the appended claims.

We claim:

1. A non-caustic aqueous cleaning composition capable of removing baked-on organic matter from a surface, said composition comprising, by weight, from about 1% to about 12% of an amine component comprising from 40% to 100% monoethanolamine and from 0% to 60% diethanolamine, from about 2% to about 20% of diethylene glycol monobutyl ether, and from about 1% to about 10% of a carbonate salt selected from the group consisting of sodium carbonate and potassium carbonate.

2. A composition according to claim 1 in which the amine component consists of monoethanolamine.

3. A composition according to claim 2 comprising from 2.5% to 8% monoethanolamine, from 3% to 15% diethylene glycol monobutyl ether and from 2% to 8% of the carbonate salt.

4. A composition according to claim 3 in which the carbonate salt is potassium carbonate.

5. A composition according to claim 4 which comprises about 5% monoethanolamine, from 5% to 10% diethylene glycol monobutyl ether and about 5% potassium carbonate.

6. A composition according to claim 5 which comprises about 10% diethylene glycol monobutyl ether.

7. An aerosol oven-cleaner formulation consisting essentially of (a) from about 2% to about 10% of a propellent and (b) from about 98% to about 90% of a cleaning composition comprising, by weight, from about 1% to about 12% of an amine component committing from 40% to 100% monoethanolamine and from 0% to 60% diethanolamine, from about 2% to about 20% of diethylene glycol monobutyl ether, and from about 1% to about 10% of a carbonate salt selected from the group consisting of sodium carbonate and potassium carbonate.

8. An aerosol oven-cleaner formulation according to claim 7 which consists essentially of (a) about 5% of a propellent selected from the group consisting of isobutane, n-butane, propane and mixtures thereof, and (b) about 95% of a cleaning composition comprising from 2.5% to 8% monoethanolamine, from 8% to 12% of diethylene glycol monobutyl ether and from 2% to 8% of sodium carbonate or potassium carbonate.

9. An aerosol oven cleaner formulation according to claim 8 in which the cleaning composition comprises about 5% monoethanolamine, about 10% diethylene glycol monobutyl ether and about 5% potassium carbonate.

* * * * *